US005841622A

United States Patent [19]

McNulty, Jr.

[11] Patent Number: 5,841,622

[45] Date of Patent: Nov. 24, 1998

[54] REMOTELY ACTIVATED ELECTRICAL DISCHARGE RESTRAINT DEVICE USING BICEPS' FLEXION OF THE LEG TO RESTRAIN

[76] Inventor: James F. McNulty, Jr., 1290 3rd. St., Calimesa, Calif. 92320

[21] Appl. No.: 18,268

[22] Filed: Feb. 4, 1998

[51] Int. Cl.[6] ..... H05C 01/00

[52] U.S. Cl. ..... 361/232; 70/15

[58] Field of Search ..... 70/15–18; 361/232; 231/7; 463/47.3; 119/816, 859, 908

[56] References Cited

U.S. PATENT DOCUMENTS

| | | | |
|---|---|---|---|
| 3,523,538 | 8/1970 | Shimizu | 361/232 |
| 3,803,463 | 4/1974 | Cover | 361/232 |
| 4,089,195 | 5/1978 | Lai | 361/232 |
| 4,253,132 | 2/1981 | Cover | 361/232 |
| 4,370,696 | 1/1983 | Darrell | 361/232 |
| 4,811,775 | 3/1989 | Sun | 361/232 |
| 4,943,885 | 7/1990 | Willoughby et al. | 361/232 |
| 5,528,450 | 6/1996 | Willoughby et al. | 361/232 |
| 5,675,103 | 10/1997 | Herr | 361/232 |
| 5,698,815 | 12/1997 | Ragner | 361/232 |

*Primary Examiner*—Fritz Fleming

[57] ABSTRACT

An electrical restraint device which, while compact and convenient for guards to install on often resistive prisoners, can accommodate a spacing of the opposed circuit contacts through a specific critical portion of the human body, so an adequately brief shock from the circuit can temporarily arrest function in the involved portions of the coordinated human muscular skeletal system and, thereby compromise the shocked individual's ambulation with the individual experiencing pain for only an extremely brief period and without causing deep burns to any significant area of his/her body. Shocking current discharged from the circuit, completes a minimal path between the prisoner's legs through a significant area of his/her legs and torso. Preferably, one contact is located at the right leg where the biceps muscle terminates into the knee and the opposing contact is located at the left leg where the biceps muscle terminates into the knee. The shocking discharges complete through a minimal path of at least two feet along the plane of function of the biceps through both biceps and the torso. During the discharge, both biceps muscles temporarily shorten, and as the prisoner attempts to step forward, both knee joints rigidly fixate with the legs in a flexed position and the prisoner collapses.

7 Claims, 4 Drawing Sheets

REMOTELY ACTIVATED ELECTRICAL DISCHARGE RESTRAINT DEVICE USING BICEPS' FLEXION OF THE LEG TO RESTRAIN

BACKGROUND OF THE INVENTION

1. Field of the Invention

The present invention relates generally to the field of prisoner devices which use electrical discharge initiated by remote activation. The invention relates more specifically to a remotely activated electrical restraint device which is more humane and more effective than existing devices.

2. Prior Art

Remotely activated electrical restraint devices for humans have been in use since at least as early as 1975. In 1993, B. Willoughby. et al was issued U.S. Pat. No. 4,943,885 for such a remotely activated restraint device consisting of a belt (which can be strapped or harnessed to a human torso under clothing in a manner lacking opprobrium), a stunning circuit, electrically opposed contacts, and remote control means. A purpose of the device is to avoid disgracing presumptively innocent prisoners by shackling them.

The device configuration that is most compact and convenient for guards to install on often resistive prisoners, is a simple belt that straps around a prisoner's torso. In fact, all manufacturers to date have produced the restrain device only in this configuration. Of course, with such belts, spacing between the opposed contacts is practically limited to about 5 inches vertically or 7 inches horizontally along an internal body discharge path. In practice, the manufacturers space the contacts a maximum of just four inches apart horizontally while indicating a reluctance to discharge current through the articulations of the spine.

All manufacturers use high tension circuits similar to those circuits described by J. Cover in his U.S. Pat. No. 4,253,132 to provide the shocking discharges. These circuits have a potential across their output contacts of about 50 KV, which is sufficient for passing through a human target a train of 0.3 to 0.5 joule sinusoidal pulses. The pulses are basically an inverted and dampened unidirectional saw tooth pulse wave with the main body of energy contained in the initial half cycle. Their sinusoidal features result from ringing in a 50 KV transformer, that is the transformer coils' collapsing inductive fields reverberating upon the coils. With the contact spacing indicated above, pain from arc burns at the body points of entry and exit of the discharge and other psychological stresses of being shocked may cause a recalcitrant prisoner to submit to a guard's instructions. However, burning prisoners to induce obedience has a number of drawbacks.

First, such shocks do not physiologically prevent the shocked prisoners from executing volitional movements, and it is well established in the literature that individuals' abilities to endure the pain of electrical shocks are highly variable. Therefore, it might be anticipated that prisoners, who are highly motivated to behave in a certain way, will still be able to carry out their intended actions, even while receiving shocks from the belts. The risk is injury to the prisoner, correctional and/or law enforcement personnel, and bystanders.

In tests conducted by the applicant, fifteen volunteers had shocks from circuits similar to those described by Cover into the skin over one of their Quadriceps extensors. Wires were connected from circuits outputting pulses at a rate of 14 or 17 pulses per second to the thigh over the quadriceps. The opposed contact points were placed approximately 2 inches apart along the sagittal plane and about halfway between the knee and the hip. The placement occurred approximately along the Vastus externus near the Rectus femoris. The volunteers then received a five second shock from the circuit. The Vastus externus could be observed to contract under the skin in response to each current pulse. Throughout each shock, the subjects attempted to repeatedly extend and flex their legs from a flex of 90 degrees to a full extension of 180 degrees through an arc along the sagittal plane or plane of basic quadriceps function. During the shock, all subjects maintained some ability to perform the leg movements. With some subjects, the ability to perform the basic movement remained unimpaired throughout the discharges. However, the average subject's movement was reduced to a 20% to 30% extension by the third second of the shock and no significant movement was occurring before the fourth second of the shock. Immediately after the shocks, the volunteers were asked to describe any pain felt during the shocks and to rate any such pain on a scale of 1 to 10 with 10 being the greatest pain believed endurable without fainting. All volunteers described the pain as a "burning" or "stinging" sensation emanating in all directions from each point of arc entry or exit for a radius of about ⅓ inch. Those volunteers whose movements were more impaired, also sensed pain emanating downward from the exit and entry points toward the bone or throughout the entire 2 inch discharge path. The pain was assigned an average value of 6 by the volunteers.

After being administered local subdermal infiltrations of 0.6 ml of 2% lidocaine at the designed points of entry and exit for a second shock, the 15 volunteers repeated the above tests. All subjects whose movement had been impaired by the discharges absent anesthesia, showed a marked improvement in their ability to extend and flex the leg throughout the discharge. The average subject could continue to fully extend the leg through the first 3 seconds of the discharge. The average subject's movement was reduced to an 80% extension by the end of the fourth second and a 60% extension by the end of the fifth second. Several volunteers could even perform the leg movements at will with an anesthetic. One told the observing researcher not to interrupt the circuit at 5 seconds, and got up and started walking about while the shock was occurring and while stating that he could dance while being shocked. The researcher interrupted the circuit and, thereby terminated the test at a 9 second discharge to avoid any more severe skin burns at the entry and exit points The pain perceived at the entry and exit points was assigned an average value of 3 by the test subjects.

It is well established in the literature that even shocks like these that are within a theoretical average "let-go" area are sufficient to produce very serious burns. It is also well established in the literature that the arcing discharges described above do indeed cause highly localized, but severe, deep tissue burns and that the severity of these burns will increase with the duration of the shock. The fifteen volunteers described above experienced highly localized third degree burns at the shocking currents points of entry and exit. With shocks of five seconds or longer, reddened areas about the diameter of a pencil eraser and with centers of coagulation necrosis between 1/32nd to 1/16th inch in diameter, were present at the point of entry or points of exit and entry of the shocking current. With shocks of 9 seconds or more deep wound cavitation began to occur at the point of current entry. Because the blood supply to the wound area is compromised, a risk of gangrenous infection exists. With all the wounds, interstitial fluid pooling occurred as a burn response. Wheals formed about 5 minutes after the shock and appeared substantially developed by 10 minutes following the shock. Some serum seepage from the wheals at the point of arc could be observed. However, with shocks of from 2 to 3 seconds no areas of surface necrosis or wound cavitation were visible.

To insure prisoner compliance, some belt manufacturers recommend shocks with a minimum duration of 8 seconds. However, many prisoners will not succumb to shocks even substantially in excess of this time. A prisoner apparently not responding to a shock, might encourage a guard to administer shocks of excessive duration. Accordingly, prisoners may be severely burned by extended shocks from the devices. Also, a reasonable person might consider it cruel and inhumane to subject a prisoner to enduring the pain of having significant fractions of his/her skin burned dead to the muscle for 10, 20 or even 30 seconds.

Shocks from the circuits described by J. Cover will not, as previously supposed, produce generalized contractions that involve the entire muscular system and that will render shocked persons immediately helpless. However, with proper spacing between the discharging contacts and at proper rates of stimulation, these circuits can produce shocks that will temporarily arrest function in the portions of the coordinated human muscular skeletal system involved in the shocking discharge.

The stun gun shock is observed to stimulate a phasic contraction of the skeletal muscle tissue in the discharge path. Put more loosely, a muscular "twitch" occurs. Of course, the overall contraction, shortening, or muscle tension caused by the twitch increases with the area of tissue involved in the discharge path. However, at any discharge path length, the muscular twitch response from a stun gun shock has insufficient tension to itself cause any movement of the joint associated with the shocked muscle. The contraction or shortening of the muscle begins to subside on interruption of the shocking pulse and the muscle might return to a fully relaxed state. However, if the rate of stimulation does not allow for the sufficient relaxation of the muscle between pulses, a constant tension (sometimes referred to as a "fused tetanus") can be developed in the muscle. Of course, the tension would still be insufficient to move the joint. But, at this rate of stimulation and with a sufficient discharge path through the muscle, a stun gun discharge can create a tension in that muscle that will prevent an opposing muscle from returning an articulation to its original position once the joint has been voluntarily moved. The shocked muscle can not relax in response to the stretch stimulus. Here, physiological responses in discharge-involved skeletal muscles, will arrest the function of portions of the coordinated muscular-skeletal system. While psychological responses will, of course, be present, physiological responses alone arrest the function. This tautness is not a contracture of the skeletal muscle in a medical sense, but is simply a mild and temporary pseudo-cramping or shortening that occurs in the skeletal muscle. The cramping is so mild that it only suffices to cause a rigid fixation of joints associated with the cramped skeletal muscles subsequent to the voluntary movement of the muscles.

Therefore, with sufficient discharge paths and rates of stimulation through specific portions of the coordinated human muscular-skeletal system, shocks from the belts might be used to effectively and reliably restrain individuals, not by completely incapacitating, but by compromising the individual's ambulation. A shock's ability to cause muscular contractions which physiologically produce an incident loss of voluntary control over the coordinated human muscular-skeletal system follows a natural distribution. Accordingly, if belt shocks could depend exclusively upon such muscular contractions to disable, the belts should disable more reliably and humanely than if they depend upon psychophysiological responses such as pain compliance for their disabling effect.

While the harness attachment for a torso belt illustrated by Willoughby et al, would allow for sufficient contact spacing, at the rates of stimulation described, the shock, if of sufficient duration, might cause acute respiratory arrest since the discharge would occur through the respiratory muscles of the thorax. Volunteers, who had shocks from circuits similar to those described by J. Cover discharged through a path from hand to hand, all complained either of apnea or at least some momentary interruption of inspiration movements occurring during the shock.

The fifteen volunteers again received shocks without benefit of a local or systemic anesthetic. For this third series of shocks, wires were connected from the opposed contacts of circuits outputting pulses at a rate of 14 or 17 pulses per second to the thigh over the quadriceps approximately 9 inches apart along the sagittal plane and beginning 2 inches up from where the tendon of the Quadriceps extensor first connects to the knee. The placement occurred approximately along the Vastus externus near the Rectus femoris. The shocks were administered to the volunteers. The wires were thereafter disconnected and then reconnected in approximately the same position prior to a further shocking of the volunteers while attempting to avoid connection over any skin burns that had been caused by the previous discharge. Prior to the further shocking, the subjects were administered local subdermal infiltrations of 0.6 ml of 2% lidocaine at each of the designed points of entry and exit for the further discharges.

While receiving the initial shocks without anesthetic, all subjects experienced a rigidly fixated extension of the leg once they voluntarily moved to bring the leg into a full extension or if beginning the series of leg movements from a 180 degree extension. Impairment of function was instantaneous. Joint locking generally occurred within 1.5 seconds and before a single leg flex could occur. Some subjects reported that the discharges compelled the leg from the flexed to the extended position where the leg fixated. The Vastus externus could be observed to phasically contract under the skin in response to each current pulse. Some subjects felt pain emanating in all directions from each point of arc entry or exit for a radius of about 1.5 cm and a sensation at the knee tendon. These subjects did not perceive other sensations or pain in the leg between the two electrical contact points. Others sensed pain along the entire length of the discharge and a sensation at the knee tendon. The painful sensation was again described as a "burning" or a "stinging" sensation. The subjects all described a locking sensation specific to the tendon of the quadriceps extensor where the Rectus femoris terminates. All stated that the locking sensation was not painful. The pain was assigned an average value of 7 by the test subjects. Some subjects panicked when the fixation occurred and cried out for the test to be terminated. In no case did the shock occur for the full five seconds. The observing researcher interrupted the current and thereby terminated the tests about 2–3 seconds into each test, when it was realized that the knee joint had fixated. Useful function of the limb was arrested within fractions of a second.

Subsequent shock tests undertaken with placement of the contacts over the volunteer's thighs 9 inches apart along a traverse plane crossing the quadriceps instead of along the plane of basic quadriceps function, disabled less effectively.

After the anesthetic had taken effect, the subjects repeated the series of leg movements while the subsequent series of stun gun shocks were discharged into their skin over their quadriceps. The subjects still could not flex the leg from a full extension during the shocks even with the anesthetic. The pain was assigned an average value of 3 by the test subjects. All other data reported remained the same as for the first discharge.

SUMMARY OF THE INVENTION

The purpose of the current invention is to provide an electrical restraint device which, while compact and convenient for guards to install on often resistive prisoners, can accommodate a spacing of the opposed circuit contacts through a specific critical portion of the human body, so an adequately brief shock from the circuit can temporarily arrest function in the involved portions of the coordinated human muscular skeletal system and, thereby compromise the shocked individual's ambulation with the individual experiencing pain for only an extremely brief period and without causing deep burns to any significant area of his/her body.

The invention comprises a belt suited to be strapped to a prisoner's leg and connected to a circuit of the type described by J. Cover. In the illustrate embodiments, the circuit has one of its output contacts adjacent to the prisoner's right leg and its opposed output contact adjacent to the prisoner's left leg. Shocking current discharged from the circuit, completes a minimal path between the prisoner's legs through a significant area of his/her legs and torso. Preferably, one contact is located at the right leg where the biceps muscle terminates into the knee and the opposing contact is located at the left leg where the biceps muscle terminates into the knee. The shocking discharges complete through a minimal path of at least two feet along the plane of function of the biceps through both biceps and the torso. During the discharge, both biceps muscles temporarily shorten, and as the prisoner attempts to step forward, both knee joints rigidly fixate with the legs in a flexed position and the prisoner collapses. The knee is the middle joint in a triple jointed support, that is essential to the human body's ambulation, balance and center of gravity equilibrium. Rigid fixation in flexion is highly unfavorable to knee function and, therefore, to weight bearing and equilibrium.

OBJECTS OF THE INVENTION

It is therefor a principal object of the invention to provide an improved electrical discharge restraint device which is more humane, more effective and less painful than prior art devices.

It is another object of the invention to provide an improved electrical discharge restraint device which is more rapidly debilitating of a prisoner, but without permanent injury.

It is yet another object of the invention to provide an electrical discharge device which is specifically designed to upset the balance of a prisoner to temporarily disable the prisoner.

It is yet another object of the present invention to provide a remotely activated restraint device designed to provide an impairment of ambulatory function with electric discharge without causing severe burns.

It is yet another object of the present invention to provide a remotely activated restraint device configured on a human body for inducing rapid involuntary flexing contractions of one or both biceps muscles of the legs.

BRIEF DESCRIPTION OF THE DRAWINGS

The aforementioned objects and advantages of the present invention, as well as additional objects and advantages thereof, will be more fully understood hereinafter as a result of a detailed description of preferred embodiments when taken in conjunction with the following drawings in which.

DETAILED DESCRIPTION OF PREFERRED EMBODIMENTS

Figure 2:
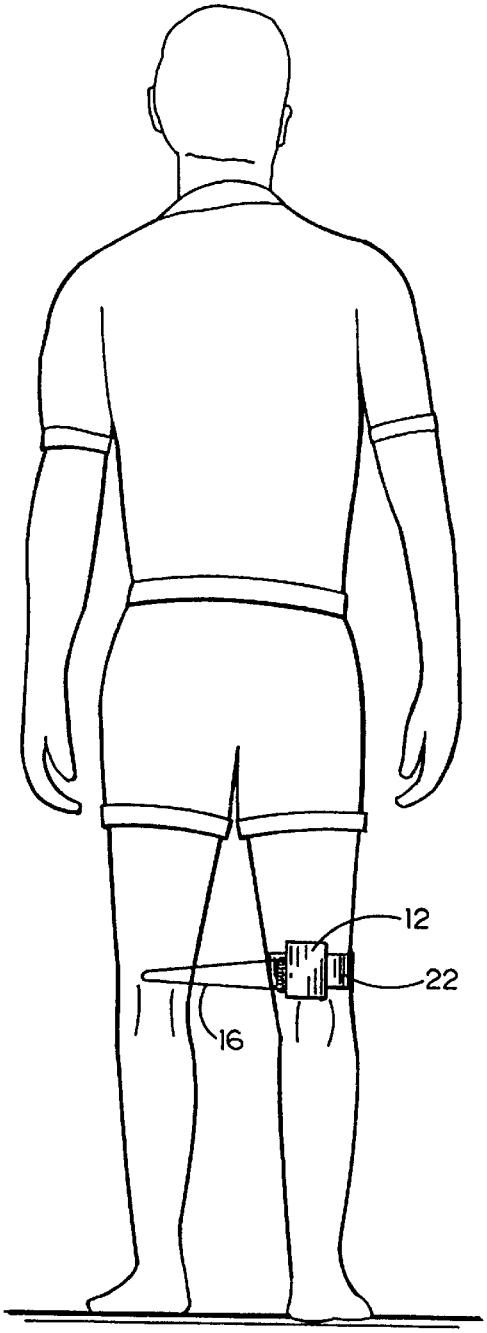
FIG. 2 is a simplified illustration of the first embodiment shown on a human.
Figure 1:
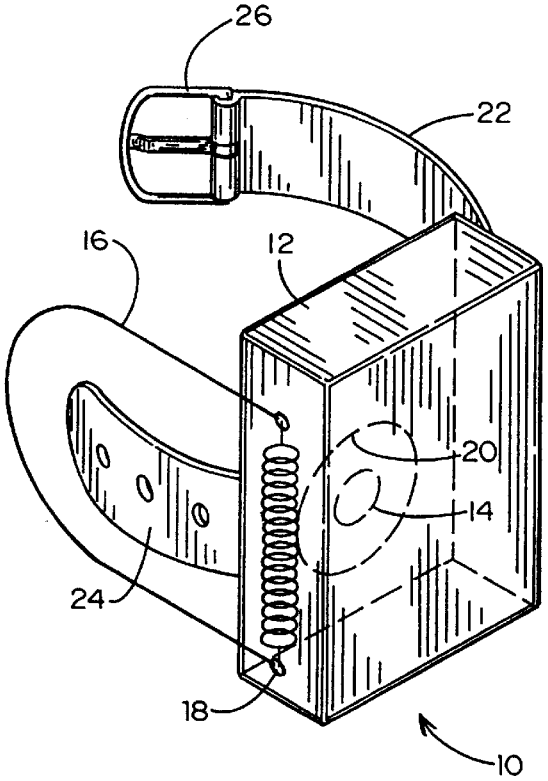
FIG. 1 is a three-dimensional view of a first embodiment of the invention.
Figure 3:
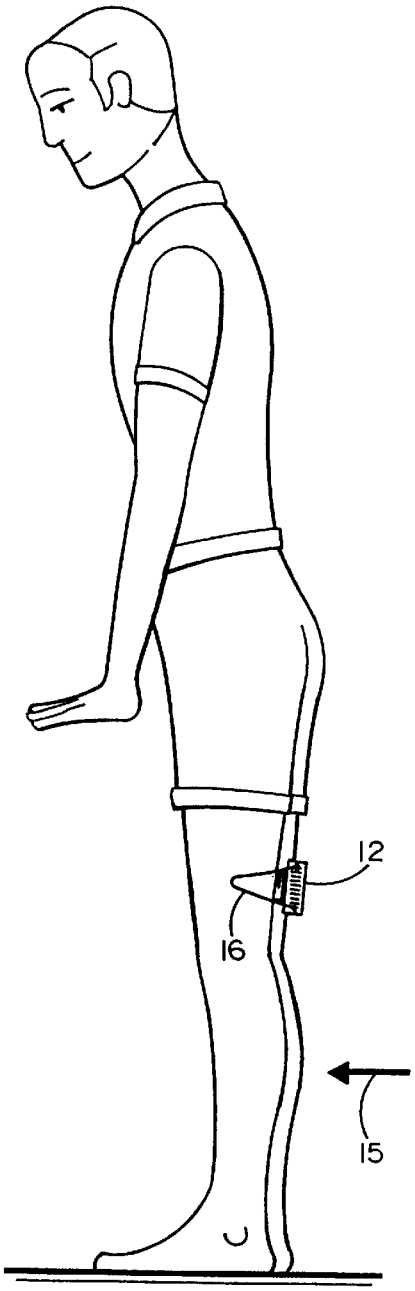
FIG. 3 is an illustration similar to that of FIG. 2 but in profile.
Figure 4:
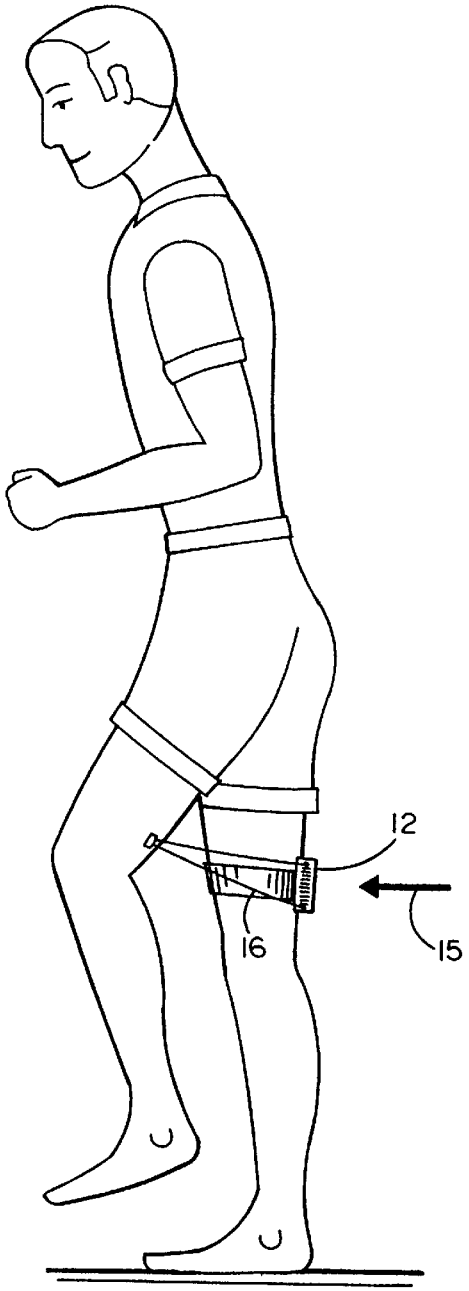
FIG. 4 is an illustration similar to that of FIG. 3 with a human shown in a bent knee configuration.

The embodiment 10 described by the drawings in FIGS. 1–4, is intended to be worn over the prisoner's garments. It consists of a circuit box 12 attached by a contacting belt 22–26 attached at the right leg where the biceps muscle terminates into the knee. A circuit contact 14 on the outside of the circuit box 12 and surrounded by an insulator 20, contacts the leg where the biceps muscle terminates into the knee. The opposed circuit contact 16 consists of a rod bent into a triangular configuration and spaced sufficiently from the first contact to prevent arc shorting. Note that the opposed contact from the high tension circuit does not need to be attached to the left leg. A spring 18 keeps the electrode rod adjacent to the left leg as the leg steps forward as shown in sequence in FIGS. 3 and 4 where arrow 15 shows the approximate position of the leg calf of the left leg. As the leg moves backward, its movement is restricted by the spring tension as it comes parallel with the right leg support. Here, the invention also acts as a fetter, which prevents the normal alternating limb gait. When the high tension circuit is remotely activated, the shocking discharge arcs from one contact into the body, travels through a body path of over two feet, and arcs from the body to the opposing contact to complete the circuit. The prisoner should collapse within 2 to 3 seconds with pain of extremely brief and humane duration and without deep tissue burns to a significant area of the body. Useful function of the limb is likely arrested within fractions of a second.

Figure 5:
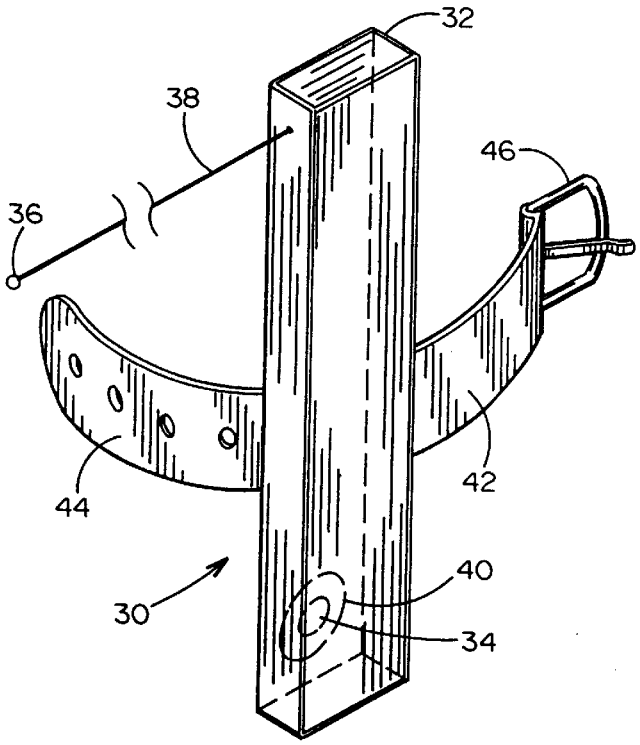
FIG. 5 is a three-dimensional view of a second embodiment of the invention.
Figure 6:
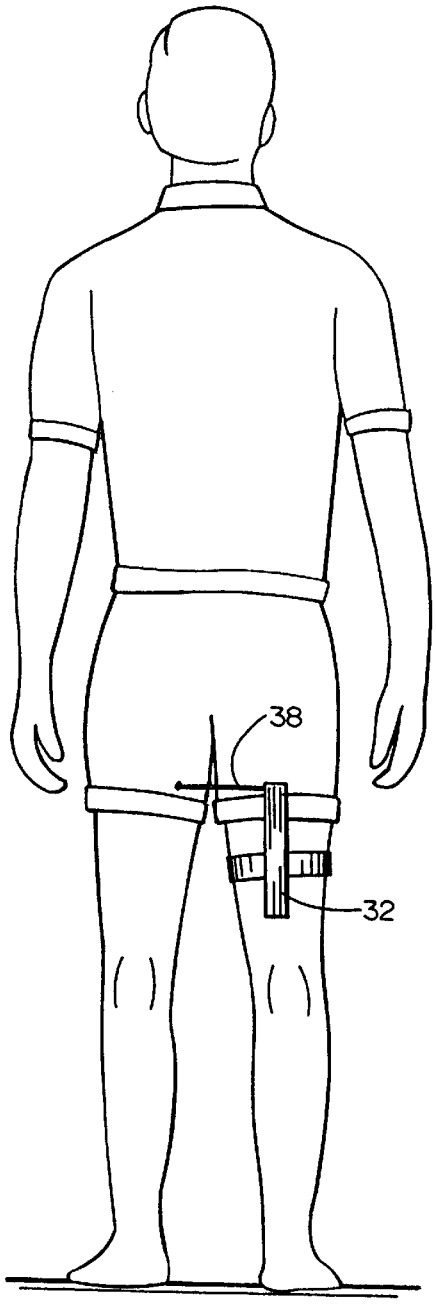
FIG. 6 is a simplified illustration of the second embodiment shown on a human.

The embodiment 30 described by the drawings in FIGS. 5 and 6, is designed to be worn under the prisoner's garments. It consists of a circuit box 32 attached by a contacting belt 42–46 attached to the right leg where the biceps muscle terminates into the knee. A circuit contact 34 on the outside of the circuit box and surrounded by an insulator 40, contacts the leg where the biceps muscles terminates into the knee. An insulated wire 38, the unconnected termination of which constitutes the opposed electrical contact 36, extends adjacent to the left leg at the buttock. Note that the opposed contact from the high tension circuit does not need to be attached to the left leg. When the high tension circuit is remotely activated, the shocking discharge arcs from one contact into the body, travels through a body path of approximately two feet, and arcs from the body to the opposing contact to complete the circuit. The prisoner should collapse within 2 to 3 seconds with pain of extremely brief and humane duration and without deep tissue burns to any significant area of the body. Useful function of the limb is likely arrested within fractions of a second of remotely activated discharge.

Of course, the invention may be implemented in numerous alternative configurations. For example, the discharge may be applied to just one limb and yet still achieve the intended result in regard to interrupting a prisoner's ambulatory function. This may be achieved by extending contact 16 of FIG. 1 or contact 36 of FIG. 5, in a direction parallel to the prisoner's leg between the knee and buttock termination regions of the biceps of just one leg. Still other alternatives may be implemented by employing a pair of contacts extending in opposite directions from a circuit box, the contacts being readily positioned at selected body locations to induce leg biceps flexion in one or both legs upon activation of the discharge.

Figure 7:
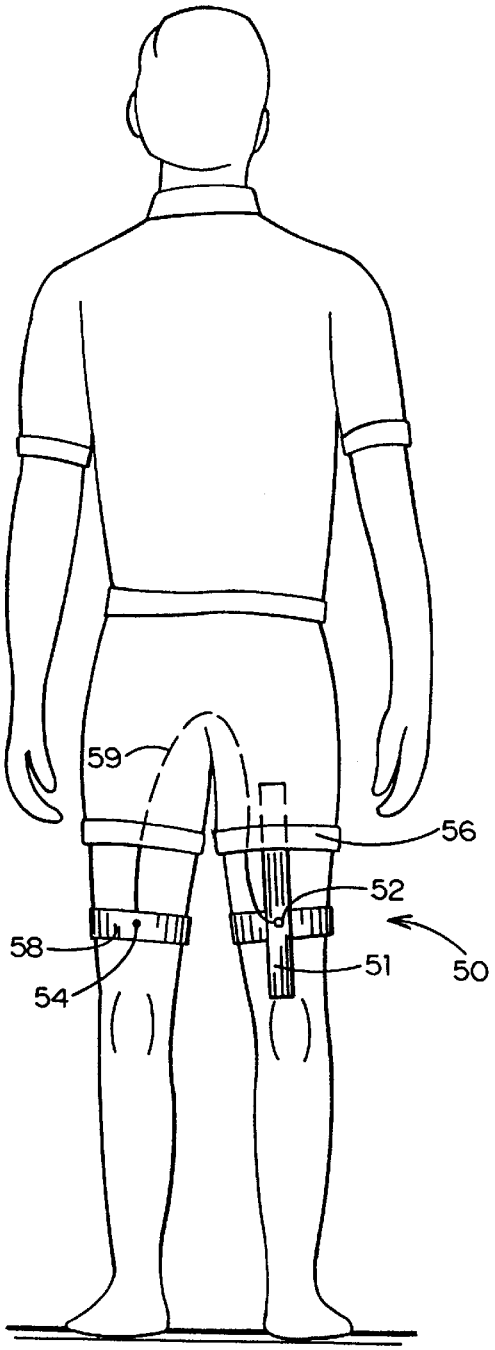
FIG. 7 is a simplified illustration of a third embodiment.
Figure 8:
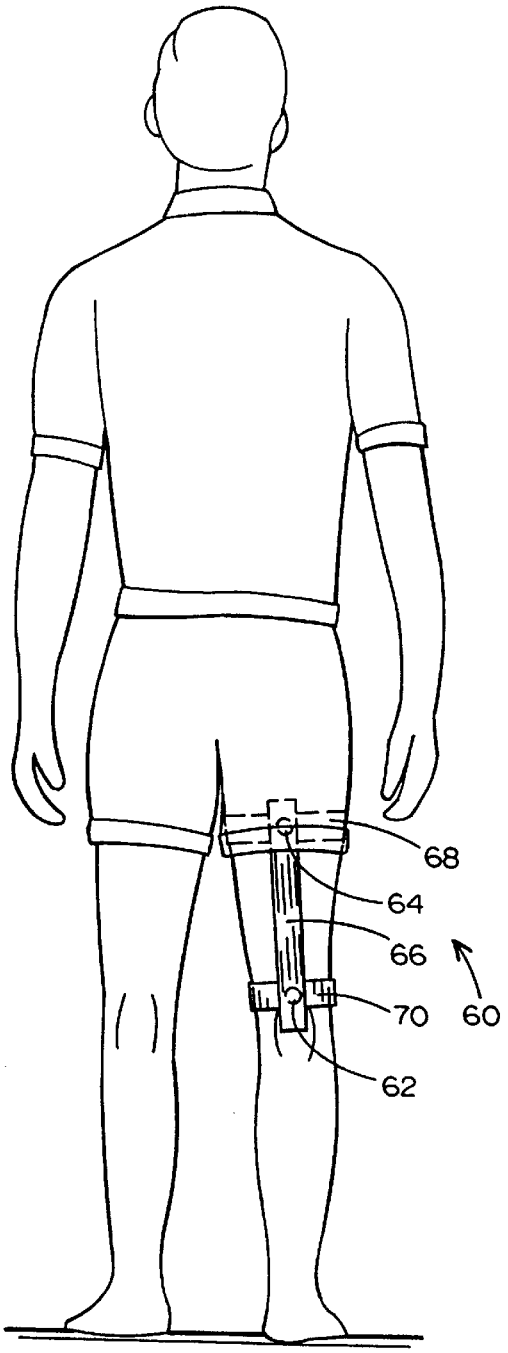
FIG. 8 is a simplified illustration of a fourth embodiment.

FIGS. 7 and 8 illustrate two such alternative configurations. In FIG. 7 a device 50 employs electrodes 52 and 54 secured to the respective legs of a prisoner by separate cuffs 56 and 58. The left leg electrode 54 is secured to the circuit box 51 by a high voltage cable 59. In FIG. 8, a device 60 employs electrodes 62 and 64 deployed at upper and lower ends of circuit box 66. Firm contact with the unitary leg is assured by using upper and lower cuffs 68 and 70.

Based upon the foregoing it will be understood that the disclosed embodiments are for purposes of illustration of the presently contemplated best mode of the invention and that the scope hereof is limited only by the appended claims and their equivalents.

I claim:

1. A remotely activated electrical discharge restraint device configured for attachment to a human body; the device comprising:

an electrical circuit for generating a selected high voltage signal;

a housing for containing said circuit and attaching said circuit to a human body;

a first contact connected to said circuit and available exterior of said housing for contacting a first location on a human body;

a second contact connected to said circuit and available exterior of said housing for contacting a second location on a human body;

the respective positions of and spacing between said first and second locations being selected to induce involuntary flexing contractions of the biceps of both legs upon transfer of said signal to said human body.

2. The restraint device recited in claim 1 wherein said first and second locations are at upper and lower terminations respectively, of a leg biceps muscle.

3. The restraint device recited in claim 1 wherein said first and second locations are at terminations of respective leg biceps muscles.

4. The restraint device recited in claim 1 further comprising a belt for securing said housing to a human body thigh.

5. The restraint device recited in claim 1 wherein said housing is configured to extend substantially the entire length of a leg biceps muscle of a human body.

6. A remotely activated electrical discharge restraint device configured for attachment to a human body; the device comprising:

an electrical circuit for generating a selected high voltage signal;

a housing for containing said circuit and attaching said circuit to a human body;

a first contact connected to said circuit and available exterior of said housing for contacting a first location on a human body;

a second contact connected to said circuit and available exterior of said housing for contacting a second location on a human body;

the respective positions of and spacing between said first and second locations being selected to induce involuntary flexing contractions of the biceps of at least one leg upon transfer of said signal to said human body;.

wherein said first contact is located on one leg and said second contact is located on another leg, said first contact being on said housing, said second contact being spring loaded at said housing and extending therefrom to said another leg.

7. The restraint device recited in claim 6 wherein said second contact comprises an insulated wire cable terminating in a non-insulated end.

* * * * *